US006853137B2

(12) United States Patent
Asano et al.

(10) Patent No.: US 6,853,137 B2
(45) Date of Patent: Feb. 8, 2005

(54) PLASMA DISPLAY PANEL, BACK PLATE OF PLASMA DISPLAY PANEL, AND METHOD FOR FORMING PHOSPHOR SCREEN FOR PLASMA DISPLAY PANEL

(75) Inventors: Masaaki Asano, Shinjuku-Ku (JP); Yoshiaki Tsuruoka, Shinjuku-Ku (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/287,190

(22) Filed: Apr. 6, 1999

(65) Prior Publication Data

US 2002/0195940 A1 Dec. 26, 2002

(30) Foreign Application Priority Data

Apr. 6, 1998 (JP) ..... 10-093165

(51) Int. Cl.[7] ..... H01J 17/49

(52) U.S. Cl. ..... 313/586; 313/587; 313/582; 313/584; 313/585

(58) Field of Search ..... 313/586, 587, 313/582, 584, 585, 112; 345/60, 80, 65, 66, 55

(56) References Cited

U.S. PATENT DOCUMENTS

| | | | | |
|---|---|---|---|---|
| 4,021,695 A | * | 5/1977 | Kamegaya et al. | 313/585 |
| 5,661,500 A | * | 8/1997 | Shinoda et al. | 313/585 |
| 5,674,553 A | | 10/1997 | Shinoda et al. | |
| 6,084,349 A | * | 7/2000 | Ueoka et al. | 313/587 |
| 6,242,860 B1 | * | 6/2001 | Sasao et al. | 313/586 |
| 6,249,264 B1 | * | 6/2001 | Sano et al. | 345/60 |
| 6,281,863 B1 | * | 8/2001 | Sasaki et al. | 345/60 |
| 6,333,600 B1 | * | 12/2001 | Mizobata | 313/587 |
| 6,448,946 B1 | * | 9/2002 | Anderson et al. | 345/60 |
| 6,611,099 B1 | * | 8/2003 | Murata et al. | 313/582 |

FOREIGN PATENT DOCUMENTS

| | | |
|---|---|---|
| JP | 3-77238 | 4/1991 |
| JP | 04-332430 | * 11/1992 |
| JP | 5-314910 | 11/1993 |
| JP | 9-092162 | 4/1997 |

* cited by examiner

*Primary Examiner*—Ashok Patel
*Assistant Examiner*—Holly Harper
(74) *Attorney, Agent, or Firm*—Parkhurst & Wendel, L.L.P.

(57) ABSTRACT

A plasma display panel having increased contrast and sharpness of image displayed on the panel. The panel includes (1) a front plate and a back plate in parallel, with a discharge gas between the plates, (2) plural pairs of composite display electrodes, each display electrode including a sustain electrode and a bus electrode, (3) a dielectric layer covering the display electrodes, and a protective film over the dielectric layer, (4) address electrodes on the back plate at right angles to the display electrode pairs, and a dielectric layer covering the address electrodes, and (5) linear ribs between the address electrodes, with phosphor layers between the adjacent linear ribs to extend intermittently in the lengthwise direction of the ribs for each pixel. Each phosphor layer covers both the dielectric layer surface and the surface of the linear ribs within each pixel. No phosphor layers are in the regions between adjacent pixels.

9 Claims, 3 Drawing Sheets

PLASMA DISPLAY PANEL, BACK PLATE OF PLASMA DISPLAY PANEL, AND METHOD FOR FORMING PHOSPHOR SCREEN FOR PLASMA DISPLAY PANEL

BACKGROUND OF THE INVENTION

1. Field of the Invention

The present invention relates to a self-luminescent plasma display panel (hereinafter referred to as PDP) that utilizes gas discharge. Precisely, it relates to PDP having a specifically designed phosphor screen, and to a method for forming the phosphor screen.

2. Description of the Related Art

Generally, PDP comprises two opposing glass substrates each having an electrode formed thereon, and a phosphor layer. This is so constructed that the two opposing glass substrates are held to have a predetermined cell space therebetween, and a vapor consisting essentially of Ne, Xe and the like is sealed in the cell space. Voltage is applied between the electrodes for attaining electric discharge in fine cell spaces around them, whereby the phosphor layer provided in each cell space is excited to emit light for displaying various informations. U.S. Pat. Nos. 5,674,553 and 5,661,500 disclose the related art for PDP.

PDP is composed of display regions that participate in displaying various informations and non-display regions that interspace the display regions while not participating in information displaying. In PDP of the related art, phosphor layers that participate in displaying are provided between linear ribs adjacent to each other, and they are in both the display regions and the non-display regions while extending along the linear ribs in their lengthwise direction.

The first problem with PDP of the related art is that the UV rays as generated through discharge in the display regions leak to the non-display regions not having ribs therearound, thereby exciting the phosphor layers in the non-display regions to emit light.

Concretely, the problem is that the phosphor in the non-image regions emits light to brighten the non-image regions. In addition, the light as emitted by the phosphor in the non-image regions leaks to the adjacent image regions to thereby brighten the image regions to a higher degree over their original brightness.

The second problem with the related art PDP is that the UV rays as generated through discharge in the display regions excite the phosphor layers therein to emit light, and the thus-emitted light leaks to the non-image regions.

In this connection, the color of the phosphor layers not emitting light is white or pale gray similar to white. Therefore, the third problem with the structure of the related art PDP is that the color of the phosphor layers is seen through the front plate of PDP owing to the ambient light entering them.

Concretely, when PDP is used in light, the ambient light entering it is scattered on the phosphor layers in the non-image regions. Therefore, the problem is that the non-image regions are seen nearly whitish.

In addition, when PDP is used in light, the ambient light entering it partly passes through the phosphor layers and is scattered on the dielectric layers underlying the phosphor layers. The scattered light again enters the phosphor layers and is further scattered on the phosphor layers in the non-image regions. This brings about the fourth problem that the non-image regions are seen nearly whitish.

All these problems cause the decrease in the contrast and the sharpness of the image informations and others displayed in PDP.

SUMMARY OF THE INVENTION

Considering the problems noted above, we, the inventors have made the present invention. The object of the invention is to provide a plasma display panel capable of displaying high-contrast and sharp image informations and others, as well as a back plate for the PDP, and also to provide a method for fabricating the PDP.

The first aspect of the invention that attain the object is a plasma display panel comprising;

a front plate and a back plate as disposed to face each other in parallel, while having a space therebetween to be filled with a discharge gas, plural pairs of display electrodes for surface discharge as provided on the front plate to be in parallel to each other, with each display electrode being a composite electrode composed of a pair of a sustain electrode and a bus electrode, a dielectric layer that covers the display electrodes, and a protective film as provided over the dielectric layer, address electrodes formed on the back plate to run at right angles to the display electrode pairs, and a dielectric layer that covers the address electrodes, and linear ribs provided between the address electrodes, with phosphor layers being so provided between the adjacent linear ribs that they each extend intermittently in the lengthwise direction of the ribs for each pixel.

Preferably, the structure of the first aspect is further provided with linear shield layers as formed on the front plate to be in parallel to each other, in which each shield layer is between the adjacent display electrode pairs to be in parallel to the display electrode pairs.

The second aspect of the invention also to attain the object is a plasma display panel comprising;

a front plate and a back plate as disposed to face each other in parallel, while having a space therebetween to be filled with a discharge gas, plural pairs of display electrodes for surface discharge as provided on the front plate to be in parallel to each other, with each display electrode being a composite electrode composed of a pair of a sustain electrode and a bus electrode, a dielectric layer that covers the display electrodes, and a protective film as provided over the dielectric layer, address electrodes formed on the back plate to run at right angles to the display electrode pairs, and a light-absorbing layer that covers the address electrodes, and linear ribs provided between the address electrodes, with phosphor layers being so provided between the adjacent linear ribs that they each extend intermittently in the lengthwise direction of the ribs for each pixel.

In the structure of the second aspect, it is desirable that the light-absorbing layer as provided on the back plate to cover the address electrodes thereon contains a dark pigment and a dielectric substance.

The third aspect of the invention also to attain the object is a plasma display panel comprising;

a front plate and a back plate as disposed to face each other in parallel, while having a space therebetween to be filled with a discharge gas, plural pairs of display electrodes for surface discharge as provided on the front plate to be in parallel to each other, with each display electrode being a composite electrode composed of a pair of a sustain electrode which is a transparent electrode, and a bus electrode which is a non-transparent metal electrode, a translucent dielectric layer that covers the display electrodes, and a magnesium oxide-containing, translucent protective film as provided over the dielectric layer, address electrodes formed on the back plate to run at right angles to the display electrode pairs, and a dark dielectric layer that covers the address electrodes, linear ribs provided between the address electrodes, and phosphor layers as so provided between the adjacent linear ribs that a red-emitting phosphor layer, a blue-emitting phosphor layer and a green-emitting phosphor layer are adjacent to each other via the rib therebetween and that these three different phosphor layers each extend intermittently in the lengthwise direction of the ribs.

Preferably, the structure of the third aspect is further provided with linear shield layers as formed on the front plate to be in parallel to each other, in which each shield layer is between the adjacent display electrode pairs to be in parallel to the display electrode pairs.

The fourth aspect of the invention also to attain the object is a back plate for plasma display panels, which comprises;

a plurality of linear address electrodes as provided on a glass substrate, a dark dielectric layer to cover the address electrodes, and linear ribs as provided between the address electrodes, and phosphor layers as so provided between the adjacent linear ribs that a red-emitting phosphor layer, a blue-emitting phosphor layer and a green-emitting phosphor layer are adjacent to each other via the rib therebetween and that these three different phosphor layers each extend intermittently in the lengthwise direction of the ribs.

In the structure of the fourth aspect, it is desirable that the dark dielectric layer as provided on the back plate to cover the address electrodes thereon contains a dark pigment and a dielectric substance.

The fifth aspect of the invention also to attain the object is a plasma display panel comprising;

a front plate and a back plate as disposed to face each other in parallel, while having a space therebetween to be filled with a discharge gas, plural pairs of display electrodes for surface discharge as provided on the front plate to be in parallel to each other, with each display electrode being a composite electrode composed of a pair of a sustain electrode and a bus electrode, a dielectric layer that covers the display electrodes, and a protective film as provided over the dielectric layer, address electrodes formed on the back plate to run at right angles to the display electrode pairs, and a dielectric layer that covers the address electrodes, and linear ribs provided between the address electrodes, with phosphor layers being so provided in each cell apace formed by the adjacent linear ribs therebetween that they do not exist in the region on the back plate which corresponds to the region between the adjacent display electrode pairs for surface discharge on the front plate.

Preferably, the structure of the fifth aspect is further provided with shield layers as so formed in the region between the adjacent display electrode pairs for surface discharge on the front plate that they are parallel to the display electrode pairs.

Also preferably, this is still further provided with a dark layer on the entire surface below the linear ribs as provided between the address electrodes on the back plate and below the phosphor layers as provided in the cell spaces formed between the adjacent linear ribs.

The sixth aspect of the invention also to attain the object is a method for forming a phosphor screen of a plasma display panel, which comprises;

a first step of applying a photosensitive phosphor paste between linear ribs as provided between address electrodes on a back plate, a second step of drying the coated phosphor paste, a third step of exposing it via a photomask having a mask pattern of masking the regions between the subpixels to undergo surface discharge, a fourth step of developing it to produce phosphor layers that intermittently remain for predetermined individual subpixels, and comprises;

after the first to fourth steps are repeated for three different color phosphors to give a phosphor screen, a final step of baking the resulting phosphor screen.

BRIEF DESCRIPTION OF THE DRAWINGS

FIG. 2A is a cross-sectional view of FIG. 2B as cut along the line A—A that runs through one address electrode vertically thereto; and FIG. 2B is a view showing the pattern of phosphor layers as provided in cell spaces between adjacent ribs.

FIG. 3A is a cross-sectional view of FIG. 3B as cut along the line B—B that runs through one address electrode vertically thereto; and FIG. 3B is a view showing the pattern of phosphor layers as provided in cell spaces between adjacent ribs.

DESCRIPTION OF PREFERRED EMBODIMENTS OF THE INVENTION

Preferred embodiments of invention are described below with reference to the drawings.

Figure 1:
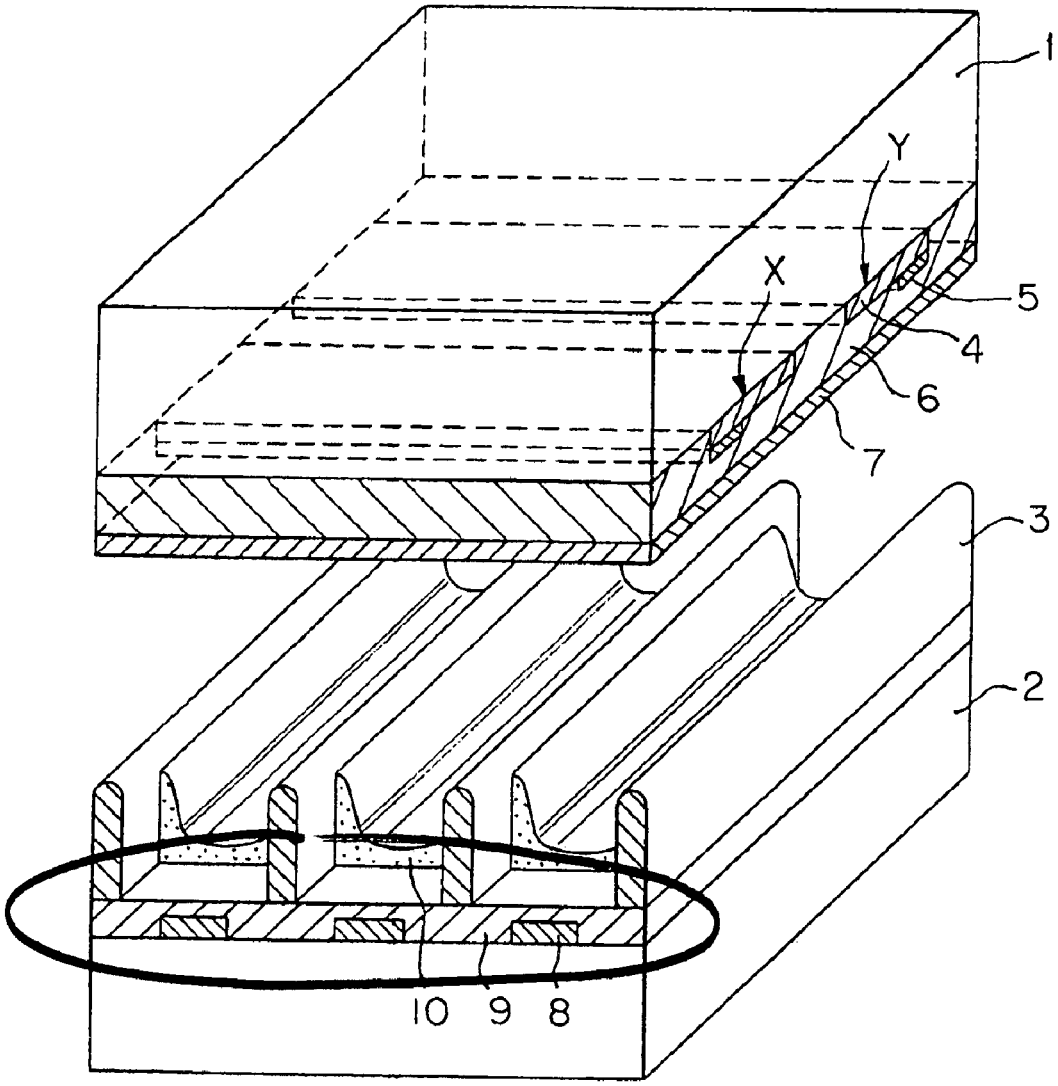
FIG. 1 is a structural view showing one embodiment of the plasma display panel of the invention, in which the front plate and the back plate are drawn separated from each other.

FIG. 1 is a structural view showing one embodiment of the plasma display panel of the invention, in which the front plate and the back plate are drawn separated from each other.

PDP of FIG. 1 is of a surface discharge-type plasma display with a three-electrode structure for an alternating current-mode (AC-mode), reflection-type matrix display mode.

As in FIG. 1, two glass substrates 1, 2 are disposed to face each other in parallel. On the glass substrate 2 to be a back plate, linear ribs 3 are provided in parallel to each other by which the discharge cell spaces are held therebetween.

On the glass substrate 1 to be a front plate, provided are a pair of parallel display electrodes X, Y that are for surface discharge. These display electrodes X, Y are both composite electrodes each composed of a sustain electrode 4 which is a wide and linear transparent electrode and a bus electrode 5 which is a narrow and linear metal electrode (of a thin metal film of Cr/Cu/Cr). In that structure, the display screen is protected as much as possible from being shaded to thereby broaden the surface discharge region so as to increase the luminescence efficiency. A dielectric layer 6 is formed to cover the display electrodes, which is for AC driving. On the dielectric layer 6, formed is a protective layer 7 of a film comprising MgO (magnesium oxide) (MgO film). The dielectric layer 6 and the protective layer 7 are both translucent.

On the glass substrate 2 to be a back plate, formed are parallel address electrodes 8 between the adjacent linear ribs 3 in such a manner that they run at right angles to the display electrodes on the front plate, and a dielectric layer 9 is formed to cover the address electrodes 8. The dielectric layer 9 controls the accumulation of charges on the side wall surface and the bottom surface of each rib 3. Phosphor layers 10 are provided between the adjacent ribs 3. The phosphor layers 10 are formed along the lengthwise direction of the linear ribs 3, intermittently for individual pixels.

The basic operation of the PDP is described. A driving voltage of from 100 to 200 volts or so is applied between the pair of display electrodes X, Y on the front plate, thereby producing an electric field in the cell spaces for discharge. The phosphor layers 10 are excited by the UV rays as generated by the electric discharge to emit predetermined visible rays for red (R), blue (B) and green (G). Viewers see the predetermined colors of visible rays having passed through the front plate.

The spaces between the ribs 3 that correspond to the pair of display electrodes X, Y to undergo discharge are to be subpixels 14 that are the constituent elements for images. Subpixels 14 of three colors, red (R), blue (B) and green (G) form one pixel 12. In the drawing, the subpixel 14 is for one color. By controlling the color of each pixel 12, displayed is a color image for the entire plasma display panel. Where a pair of display electrodes X, Y within the range of the pixel 12 undergo surface discharge, the space between that display electrode pair X, Y and the other neighboring display electrode pairs X, Y adjacent thereto is made satisfactorily larger than the space between the display electrodes of that pair (that is, the space between one display electrode X and the other display electrode Y to form that pair) to thereby prevent any abnormal discharge. The region between the display electrode X and the display electrode Y is the discharge region and is the display region. The display region for each color corresponds to the subpixel 14 for each color. The display region for three colors, R, B and G, corresponds to the pixel 12. The region between the display electrode pair X, Y and the neighboring display electrode pair X, Y adjacent thereto is the non-discharge region and is the non-display region. This corresponds to the region 13 between the adjacent pixels.

Figure 2A:
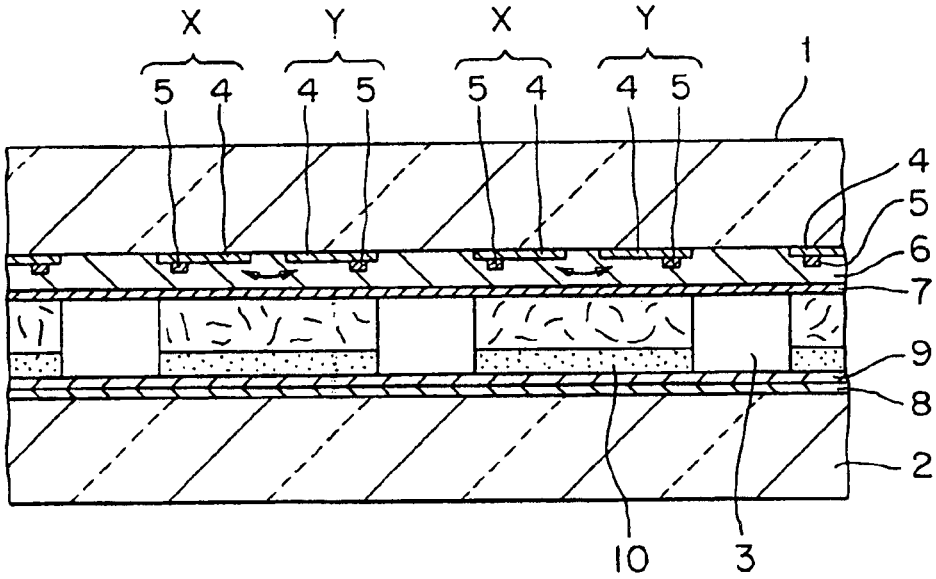
FIG. 2A and FIG. 2B are structural views showing one embodiment of the plasma display panel of an AC mode of the invention. Precisely.
Figure 2B:
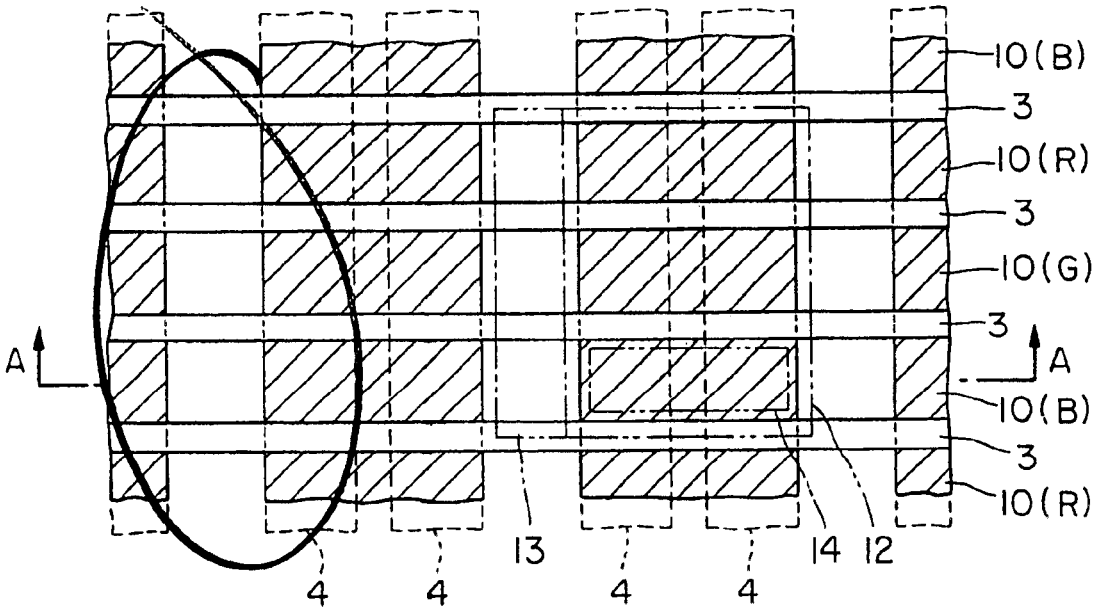

FIG. 2A and FIG. 2B are structural views showing one embodiment of the plasma display panel of an AC mode of the invention. Precisely, FIG. 2A is a cross-sectional view of FIG. 2B as cut along the line A—A that runs through one address electrode vertically thereto; and FIG. 2B is a view showing the pattern of phosphor layers as provided in cell spaces between adjacent ribs.

PDP of FIG. 2A and FIG. 2B is of the same type as that of FIG. 1, and the same parts are designated by the same reference numerals or codes in those drawings.

As its basic configuration, this PDP is composed of a pair of opposing glass substrates 1, 2 that face each other while sandwiching therebetween the cell spaces as partitioned by the ribs 3. The glass substrates 1, 2 are bonded by a framed seal layer (not shown) of low-melting-point glass as provided around their peripheries, and sealed space between them is filled with a discharge gas.

On the inner surface of the glass substrate 1, which is a front plate, a pair of parallel display electrodes X, Y are provided for every matrix display line, and those plural pairs of parallel display electrodes are for surface discharge along the substrate surface. In one example of the configuration, the line pitch in a diagonal 42-inch full-color PDP is 1080 μm. The display electrode pair X, Y is of a composite electrode that is composed of a narrow and linear bus electrode 5 (of a thin metal film of Cr/Cu/Cr) and a sustain electrode 4 which is a transparent, wide and linear electrode. Regarding their size, the bus electrode 5 has a thickness of 1 μm and a width of 60 μm, and the sustain electrode 4 has a thickness of 0.2 μm and a width of 240 μm. A dielectric layer 6 (of PbO-based, low-melting-point glass) for AC driving is provided to cover the composite electrode. On the surface of the dielectric layer 6, formed is a protective layer 7 of MgO (magnesium oxide). The thickness of the dielectric layer 6 is about 30 μm, and that of the protective layer 7 is 0.5 μm.

On the other hand, address electrodes 8 are provided on the inner surface of the glass substrate 2 which is a back plate. The address electrodes 8 all run at right angles to the plural pairs of X, Y provided on the front plate. These address electrodes 8 may be formed by applying a silver paste onto the inner surface of the glass substrate 2 according to a screen-printing method, then drying and baking it. Each address electrode 8 thus formed at a pitch of 360 μm may have a width of 100 μm and a thickness of 10 μm. An insulating dielectric layer 9 is formed to cover the address electrodes 8. The thickness of the dielectric layer 9 may be about 20 μm. In order to prevent the electromigration of the address electrodes 8, a subbing layer is formed below the address electrodes. The subbing layer may be of low-melting-point glass having the same composition as that of the dielectric layer 9. The subbing layer is not shown in the drawings.

On the dielectric layer 9, formed are linear ribs 3 to stand between the address electrodes. The height of each rib 3 may be 120 μm, the bottom width thereof may be 100 μm, and the top width thereof may be 60 μm. Phosphor layers 10 of three colors of red (R), blue (B) and green (G) for color display are formed to cover the surface of the dielectric layer 9 and the side surfaces of each rib 3. A driving voltage is applied to the pairs of display electrodes X, Y to induce surface discharge. The UV rays as generated by the surface discharge excite the phosphor layers 10 to emit light. In this stage, the space between the adjacent ribs 3 as provided on the back plate while corresponding to the pair of display electrodes X, Y provided on the front plate is to be one subpixel 14. Specifically, the discharge spaces along the linear ribs 3 are to be unit display regions (that is, subpixels 14) that run in the direction of the lines of the linear ribs 3. Above the linear ribs 3, the unit display region and the non-display region are alternately repeated along the rib lines.

FIG. 2B is referred to, which is a plan view of the plasma display panel. In this, when the surface area of the phosphor layers 10 of three colors, red (R), blue (B) and green (G) for one pixel is compared with the surface area of the pixel electrode pair X, Y for one pixel, it is desirable that the two are nearly the same. Taking the alignment error into consideration, it is desirable that the peripheral misregistration error falls within the range of ±60 μm or so, preferably ±30 μm or so, more preferably ±10 μm or so. This is because if the surface area of the phosphor layers is too large, the first problem noted above could not be solved. On the other hand, if the surface area of the phosphor layers is too small, the plasma display panel will be dark.

In the PDP illustrated, the ribs 3 for partitioning discharge are present in the direction of the lines of the pairs of display electrodes X, Y for matrix display, but no ribs for partitioning discharge are present in the direction of the lines of the address electrodes B and the ribs 3. In the absence of such ribs, the distance between one pair of display electrodes and the neighboring pairs of display electrodes adjacent thereto shall fall between 200 and 600 μm. That distance therebetween is much larger than the discharge space (50 μm) between one display electrode X and the other display electrode Y to form one pair. In that situation, therefore, there occurs no abnormal discharge (discharge interference) between the neighboring pairs of display electrodes adjacent to each other.

In the embodiment of the invention as illustrated in FIG. 2A and FIG. 2B, no phosphor layer is present in the spaces between the neighboring pairs of display electrodes adjacent to each other, or that is, in every non-display region. The phosphor layers 10 that are in the same column running along the linear ribs emits 3 the same color. The phosphor layers 10 are formed intermittently between the ribs, while being partly interrupted by the non-display region parts. One method for forming the phosphor layers is mentioned below.

A phosphor paste for each color is applied onto the entire surface of a substrate according to a screen-printing method, a blade-coating method or a die-coating method, and then dried at a predetermined temperature. This is then exposed via a photomask having a mask pattern of masking the non-display regions, and thereafter developed to form an intermittent pattern of the phosphor layers 10 within a predetermined discharge space. The phosphor layer as removed in this step is recycled for the phosphor paste. Recycling this could reduce the amount of the phosphor to be used, and therefore could reduce the production cost. The process comprising the photosensitive phosphor paste coating step, the drying step, the exposure step and the development step is repeated for the number of predetermined colors (in general, for three colors of red (R), blue (B) and green (G)), whereby are formed the necessary color phosphor layers 10 as partitioned in the discharge spaces. Photolithography is favorable to uniformly forming such fine, intermittent patterns with ease. Finally, the phosphor screen comprising the thus-formed phosphor layers is baked to remove the organic component from the layers. According to that method, obtained is the back plate for PDP having the different color phosphor layers 10(R), 10(B) and 10(G) as patterned in an intended manner in predetermined cell spaces, as in FIG. 2B.

Figure 3A:
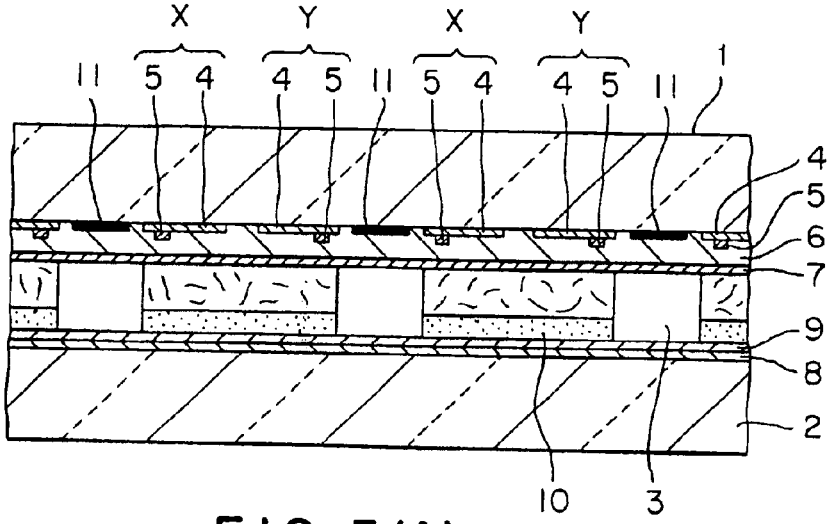
FIG. 3A and FIG. 3B are structural views showing another embodiment of the plasma display panel of an AC mode of the invention. Precisely.
Figure 3B:
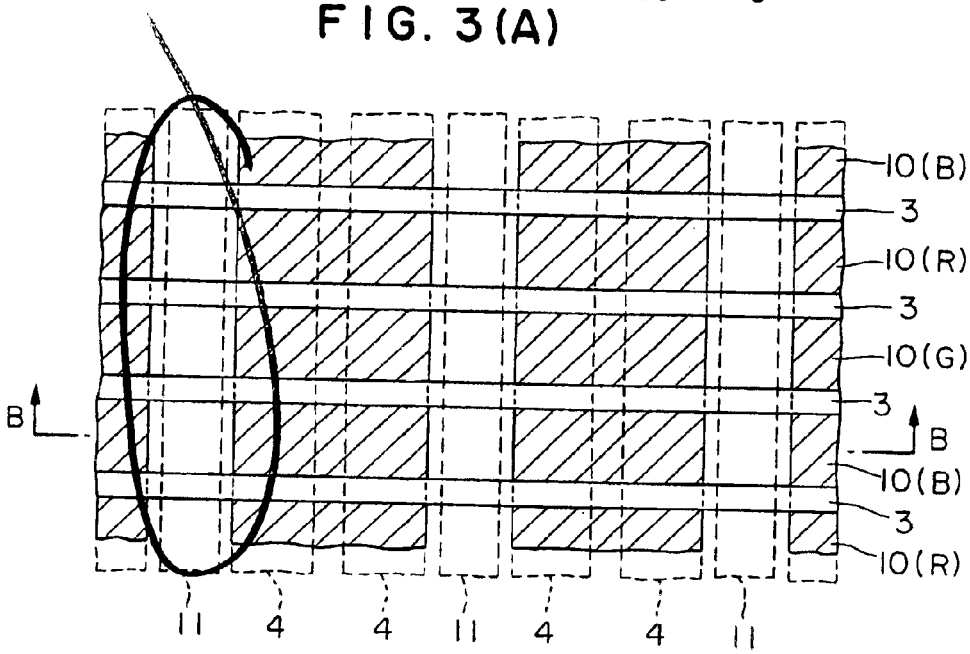

FIG. 3A and FIG. 3B are structural views showing another embodiment of the plasma display panel of an AC mode of the invention. Precisely, FIG. 3A is a cross-sectional view of FIG. 3B as cut along the line B—B that runs through one address electrode vertically thereto; and FIG. 3B is a view showing the pattern of phosphor layers as provided in cell spaces between adjacent ribs.

In the plasma display panel of FIG. 3A and FIG. 3B, shield layers 11 are formed between the adjacent display electrode pairs, running in parallel to the display electrodes. In this, the phosphor in the display regions emits light, while the display regions are shielded from light that leaks from the non-display regions. Therefore, the PDP could produce sharp images.

In the embodiments of FIGS. 2A and 2B and FIGS. 3A and 3B, it is more desirable that the dielectric layer 9 which covers the address electrodes on the back plate acts as a light-absorbing layer. For this, the dielectric layer 9 may be a dark layer acting as a light-absorbing layer. Though not shown, an additional dark layer may be provided over the dielectric layer 9 to attain the same effect. However, using the dielectric layer 9 as a light-absorbing layer is more preferred in view of the production efficiency, as not requiring an additional step for providing such an additional dark layer.

In particular, the embodiment of FIGS. 2A and 2B has no shield layer on the front plate, being different from that of FIGS. 3A and 3B. In the former, therefore, the dielectric layer 9 in the area in which the phosphor layers do not exist is seen. The dielectric layer is white or whitish gray. However, it is not so much white, dislike the phosphor. Therefore, in the embodiment of FIGS. 2A and 2B, where a dark layer is formed in the entire surface below the phosphor layers on the back plate, the screen is prevented from looking whitish as a whole.

Concretely, for this purpose, it is desirable that the dielectric layer 9 to cover the address electrodes 8 are dark. Alternatively, an additional dark layer may be formed, apart from the dielectric layer 9.

The composition of the phosphor paste (that is, the composition for forming the phosphor layers) is mentioned below.

The phosphor paste may be prepared by mixing a binder resin, a photopolymerizable monomer, a photopolymerization initiator, a phosphor and an organic solvent.

The binder resin may be a cellulose derivative or an acrylic copolymer, concretely including methyl cellulose, ethyl cellulose, ethoxy cellulose, methylhydroxyethyl cellulose, methylhydroxypropyl cellulose, methylhydroxypropyl cellulose acetate succinate, hydroxypropyl cellulose, cellulose propionate, acetylethyl cellulose, acetyl cellulose, butyl cellulose, benzyl cellulose, etc.

In order to make the phosphor paste layer as formed by coating and drying the phosphor paste on the substrate, developable with water, a cellulose derivative that is soluble both in water and in an organic solvent, for example, hydroxypropyl cellulose is selected and used as the binder resin.

The photopolymerizable monomer includes, for example, 2-hydroxy-3-phenoxypropyl mono(meth)acrylate, 2-hydroxyethyl (meth)acrylate, ethylene glycol mono(meth) acrylate, cyclohexyl (meth)acrylate, 2-ethylhexyl (meth) acrylate, lauryl (meth)acrylate dimethylaminoethyl (meth) acrylate, ethylene glycol di(meth)acrylate, diethylene glycol di(meth)acrylate, triethylene glycol di(meth)acrylate, tetraethylene glycol di(meth)acrylate, polyethylene glycol di(meth)acrylate, polypropylene glycol di(meth)acrylate, bisphenol A-alkylene oxide adduct di(meth)acrylate, trimethylolpropane tri(meth)acrylate, alkylene oxide-modified trimethylolpropane tri(meth)acrylate, pentaerythritol hydroxy-tri(meth)acrylate, alkylene oxide-modified pentaerythritol hydroxy-tri(meth)acrylate, pentaerythritol tetra (meth) acrylate, alkylene oxide-modified pentaerythritol tetra(meth)acrylate, ditrimethylolpropane tetra(meth) acrylate, alkylene oxide-modified ditrimethylolpropane tetra (meth)acrylate, dipentaerythritol penta(meth)acrylate, dipentaerythritol hexa(meth)acrylate, etc. One or more of these may be used.

Preferably, the photopolymerization initiator has light absorbance at 400 to 480 nm. For example, it may be 2,4,6-trimethylbenzoyldiphenylphosphine oxide.

In addition to it, the following compounds may also be used as the photopolymerization initiator.

Bis(2,4,6-trimethylbenzoyl)-phenylphosphine oxide,

Bis(2,6-dimethoxybenzoyl)-2,4,4-trimethylpentylphosphine oxide,

2-Hydroxy-2-methyl-1-phenyl-propan-1-one,

1-Hydroxycyclohexyl phenyl ketone,

2-[2-(5-methylfuran-2-yl)ester]-4,6-bis(trichloromethyl)-s-triazine,

2-[2-(furan-2-yl)ether]-4,6-bis(trichloromethyl)-s-triazine.

The compounds mentioned above may be used either singly in a single system or as combined in a composite system, and, if desired, could be further combined with the following compounds:

2-Methyl-1-[4-(methylthio)phenyl]-2-morpholinopropan-1-one, 2,4-Diethylthioxanthone, N,N'-tetramethyl-4,4'-diaminobenzophenone, Isopropylthioxanthone, 2,4-Dichlrothioxanthone, 2,2-Dimethoxy-1,2-diphenylethan-1-one, 2-Benzyl-2-dimethylamino-1-(4-morpholinophenyl)-butan-1-one, 2,4,6-Trimethylbenzoylphenylphosphine oxide.

The photopolymerization initiator content of the phosphor paste preferably falls between 3 and 10% by weight relative to 100 parts by weight of the paste.

If the content is smaller than 3% by weight, the photopolymerizable monomer in the paste layer will unsatisfactorily cure when the layer is exposed. As a result, the layer will peel off or its thickness will reduce, while the layer is developed.

After the phosphor pattern-forming composition has been coated, dried and developed to give a desired pattern, it is baked (at 400 to 550° C.) so as to remove the excess resin component, photopolymerization initiator and other additives from it.

In that stage, if the photopolymerization initiator content is larger than 10% by weight, the baked layer will be yellowed owing to the excess photopolymerization initiator remaining therein, whereby the brightness of the phosphor screen will be lowered.

The phosphor for use in the invention is not specifically defined, and any known ones are employable.

For example, the red phosphor usable herein includes;

$Y_2O_3$:Eu, $Y_2SiO_5$:Eu, $Y_8Al_5O_{12}$:Eu, $Zn_3(PO_4)_2$:Mn, (Y,Cd)$BO_3$:Eu, $YO_3$:Eu, etc.

The green phosphor includes;

$Zn_2SiO_4$:Mn, $BaAl_{12}O_{19}$:Mn, $YBO_3$:Tb, (Ba,Sr,Mg)O.a$Al_2O_3$:Mn, etc.

The blue phosphor includes;

$Y_2SiO_5$:Cl, $CaWO_4$;Pb, $BaMgAl_{14}O_{23}$:Eu, $BaMgAl_{10}O_{17}$:Eu, etc.

The organic solvent includes ethers, ether esters, esters, amides, alcohols, ketones, acetates, ketone esters, glycols, glycol esters, sulfones, sulfoxides, halogenohydrocarbons, and hydrocarbons.

Regarding the proportions of the components constituting the phosphor paste (that is, the phosphor layer-forming composition), the amount of the photopolymerizable polymer must be from 100 to 300 parts by weight, but preferably from 160 to 250 parts by weight, relative to 100 parts by weight of the binder resin. The amount of the photopolymerization initiator must be from 30 to 100 parts by weight, but preferably from 50 to 90 parts by weight, relative to 100 parts by weight of the binder resin. The amount of the organic solvent must be from 500 to 1500 parts by weight, but preferably from 800 to 1200 parts by weight, relative to 100 parts by weight of the binder resin. The amount of the phosphor powder must be from 500 to 1500 parts by weight, but preferably from 800 to 1200 parts by weight, relative to 100 parts by weight of the binder resin.

If the proportions of the constituent components overstep the defined ranges, there will occur the following problems.

If the amount of the photopolymerizable monomer is smaller than 100 parts by weight, the paste will unsatisfactorily cure when exposed to light. As a result, the paste to be the image area will dissolve out when developed, and good images could not be formed. Even if images could be formed, the phosphor layers are poorly formed on the wall surface, and the luminescent characteristics of the phosphor screen are degraded. On the other hand, if the amount of the photopolymerizable monomer is larger than 300 parts by weight, the monomer could not be completely baked away in the step of baking the phosphor layers but will still remain in the baked layers to yellow the phosphor screen. As a result, the luminescent characteristics of the phosphor screen will be degraded.

If the amount of the photopolymerization initiator is smaller than 30 parts by weight, the paste layer could not be sufficiently cured in an ordinary exposure condition. As a result, the paste to be the image area will dissolve out when developed, and images could not be formed. If, on the other hand, the amount of the photopolymerization initiator is larger than 100 parts by weight, the initiator could not uniformly disperse in the solvent since its solubility in the solvent is low. As a result, fine images could not be formed, and, in addition, the light transmittance of the phosphor screen is lowered.

If the amount of the phosphor powder is smaller than 500 parts by weight, the phosphor screen formed could not have good luminescent characteristics. In addition, the baked phosphor layers could not have good mechanical strength. If, on the other hand, the amount of the phosphor powder is larger than 1500 parts by weight, too much phosphor will absorb a large amount of ultraviolet rays whereby the UV transmittance of the paste layer will lower. As a result, the action of the photopolymerization initiator in the paste layer is retarded, thereby resulting in that the paste layer to be the image area will dissolve out, when developed, and images could not be formed.

If the amount of the organic solvent is smaller than 500 parts by weight, the viscosity of the phosphor paste will increase too much, and the paste could not form a film. If, on the other hand, the amount of the organic solvent is larger than 1500 parts by weight, the viscosity of the phosphor paste will be too low, and the phosphor will precipitate and deposit in the paste.

It is desirable that the phosphor paste as prepared by mixing the constituent components has a viscosity at 25° C. of from 5000 to 50000 mPa, more preferably from 10000 to 30000 mPa. If the viscosity is lower than 5000 mPa, the phosphor will unfavorably separate and deposit in the paste. If, on the other hand, the viscosity is higher than 50000 mPa, the phosphor paste having such a high viscosity could not form a film.

If desired, the phosphor paste may additionally contain a thermal polymerization inhibitor, dye and pigment for visualizing the phosphor layers, a defoaming agent, etc.

The invention is described in more detail with reference to the following Examples, which, however, are not intended to restrict the scope of the invention.

EXAMPLE 1

On the inner surface of a glass substrate of a back plate, aligned are address electrodes at a predetermined pitch (360

μm) so that they run at right angles to the display electrode pair lines as formed on a front plate. The address electrodes are of silver, as formed according to a printing method for forming thick films. Precisely, a mixture of silver powder and glass powder is mixed with an organic solvent and a resin to prepare a paste. This is patterned on the substrate of the back plate according to a printing method. Then, this is leveled at room temperature for 10 minutes to thereby smooth the surface of the pattern, and thereafter dried at 100° C. for 15 minutes. The thus-dried film is then baked in a baking furnace at 580° C. for 60 minutes to remove the organic substances from it.

After the address electrodes have been formed in the manner mentioned above, a dielectric layer is formed thereover. Precisely, a paste of low-melting-point glass is printed over the address electrodes according to a screen-printing method, and then baked at 560° C. The thickness of the baked dielectric layer must be enough to completely cover all the address electrodes. In this Example, the thickness of the address electrodes is 6 μm, and that of the dielectric layer is 10 μm.

After the dielectric layer has been formed to cover the address electrodes, ribs are formed on the dielectric layer. For the ribs, prepared is a paste by adding an organic solvent and a resin to a mixture of low-melting-point glass powder and a powdery filler to be an aggregate, followed by mixing them. The resulting rib material is applied onto the dielectric layer at a thickness of 420 μm, using a die coater, and then dried at 150° C. for 50 minutes to form a rib layer having a thickness of 180 μm. The rib layer is sand-blasted to remove the unnecessary parts, thereby forming the intended ribs.

Concretely, the rib layer is sand-blasted in the manner mentioned below.

The substrate as coated with the rib material by the use of a die coater is dried. After heated at 80° C., this is laminated with a dry film resist to cover the rib layer. The dry film resist is processed into a mask for sand-blasting. Precisely, the laminated dry film resist is exposed to UV rays via a line pattern mask having a line width of 90 μm and a pitch of 360 μm. The thus-exposed dry film resist is spray-developed with an aqueous solution of sodium carbonate at 30° C. into a sand-blasting mask having a line width of 90 μm and a pitch of 360 μm. Via the sand-blasting mask, the rib layer is sand-blasted to remove the unnecessary parts from it. After having been sand-blasted in that manner, this is processed with an spray of an aqueous solution of sodium hydroxide at 30° C. to remove the sand-blasting resist mask from it. Next, this is baked in a baking furnace at a peak temperature of 550° C. for 60 minutes to form the intended ribs. The height of each rib is 120 μm, the bottom width thereof is 100 μm, and the top width thereof is 60 μm. Apart from the method of coating the rib material as herein, the rib layer may also be formed according to a transfer method using a rib sheet. Also apart from the sand-blasting method as herein, the ribs may be formed in any other methods. For example, employable is a method of patternwise printing the rib material through screen-printing followed by baking the thus-printed rib pattern; or a method of filling the rib material into the spaces of a female pattern of a resist or the like as formed on the substrate, then removing the female pattern, and baking the resulting rib pattern.

After the ribs have been formed on the dielectric layer in the manner mentioned above, phosphor layers of three colors, red (R), blue (B) and green (G), are formed in predetermined positions between the adjacent ribs.

The process of forming the phosphor layers is mentioned below. First, a photosensitive phosphor paste containing a red-emitting phosphor powder is coated on the entire surface, using a die coater, and then dried in a drying furnace at 90° C. for 30 minutes. In this stage, the cross-sectional profile of each phosphor layer between the adjacent ribs, as cut in the direction perpendicular to the underlying address electrodes, shall be curved downward at its center. The composition of the photosensitive phosphor paste is mentioned below.

Red Phosphor Paste:

| | |
|---|---|
| Red-emitting phosphor, $(Y,Gd)BO_3$:Eu (trade name, NP-360-03, from Nichia Chemical Industry) | 630 parts |
| Hydroxypropyl cellulose (trade name, Nisso HPC, from Nippon Soda) | 57 parts |
| Pentaerythritol tetraacrylate | 80 parts |
| 2-Hydroxy-3-phenoxypropyl acrylate | 20 parts |
| 2,4,6-Trimethylbenzoyldiphenylphosphine oxide | 30 parts |
| Hydroquinone | 0.1 parts |
| Defoaming agent | 10 parts |
| 3-Methoxy-3-methyl-1-butanol | 580 parts |

The components mentioned above are mixed in a three-roll mill to prepare a phosphor paste.

As measured with a B-type rotary viscometer, the viscosity of the composition is 21000 mPa at 25° C.

Next, the phosphor layer is patternwise exposed via a photomask having a mask pattern of masking the area not to be the subpixels of each color. For the exposure, used is a Phillips' UV lamp "TL180W/10R", and the exposure amount is 500 mJ/cm$^2$. Next, the phosphor layer thus having been patternwise exposed is developed with a spray of water at 28° C. As the case may, it is desirable that the top of each rib is polished with a rolling surface or the like, while the developed phosphor pattern is still soft, to remove the phosphor from the top of each rib. In that manner, the red phosphor layers are formed at intervals of two rib-to-rib spaces which are for phosphor layers of two other colors. Each red phosphor layer thus formed is on the inner side walls of the adjacent ribs and on the bottom of the rib-to-rib space. In the embodiment of this Example, the phosphor layers are not formed in the non-image regions. In other words, the phosphor layers are formed intermittently. The length of each phosphor layer in the rib running direction is 530 μm, and the pitch of the layers is 1080 μm. The width of each phosphor layer in the direction perpendicular to the rib running direction is 300 μm, and the pitch of the layers is 1080 μm.

Next, a photosensitive phosphor paste containing a green-emitting phosphor powder is coated to form green phosphor layers, in the same manner as above for forming the red phosphor layers from the red phosphor powder-containing paste.

The composition of the photosensitive phosphor paste for the green phosphor layers is mentioned below.

Green Phosphor Paste:

| | |
|---|---|
| Green-emitting phosphor, $Zn_2SiO_4$:Mn (trade name, NP-200-41, from Nichia Chemical Industry) | 570 parts |
| Hydroxypropyl cellulose (trade name, Nisso HPC, from Nippon Soda) | 57 parts |
| Pentaerythritol tetraacrylate | 100 parts |
| 2-Hydroxy-3-phenoxypropyl acrylate | 30 parts |
| 2,4,6-Trimethylbenzoyldiphenylphosphine oxide | 50 parts |
| Hydroquinone | 0.1 parts |
| Defoaming agent | 10 parts |
| 3-Methoxy-3-methyl-1-butanol | 500 parts |

These components are mixed in a three-roll mill to prepare a phosphor paste.

As measured with a B-type rotary viscometer, the viscosity of the composition is 25000 mPa at 25° C.

Next, a photosensitive phosphor paste containing a blue-emitting phosphor powder is coated to form blue phosphor layers, in the same manner as above for forming the red phosphor layers from the red phosphor powder-containing paste.

The composition of the photosensitive phosphor paste for the blue phosphor layers is mentioned below.

Blue Phosphor Paste:

| | |
|---|---|
| Blue-emitting phosphor, $BaMgAl_{10}O_{17}$:Eu (trade name, NP-107-44, from Nichia Chemical Industry) | 520 parts |
| Hydroxypropyl cellulose (trade name, Nisso HPC, from Nippon Soda) | 57 parts |
| Pentaerythritol tetraacrylate | 100 parts |
| 2-Hydroxy-3-phenoxypropyl acrylate | 30 parts |
| 2-Methyl-1-[4-(methylthio)phenyl]-2-morpholinopropan-1-one | 40 parts |
| 2,4-Diethylthioxanthone | 10 parts |
| Hydroquinone | 0.1 parts |
| Defoaming agent | 10 parts |
| 3-Methoxy-3-methyl-1-butanol | 520 parts |

These components are mixed in a three-roll mill to prepare a phosphor paste.

As measured with a B-type rotary viscometer, the viscosity of the composition is 25000 mPa at 25° C.

As in the manner mentioned above, formed are the phosphor layers containing any of red-, green- or blue-emitting phosphor powders. Next, the phosphor layers are baked in a baking furnace at 480° C. for 60 minutes to remove the organic component from the layers. As a result, obtained is a back plate having thereon red, green and blue phosphor layers as patterned in predetermined cell spaces. The back plate thus having the phosphor layers formed thereon is combined with a front plate having been prepared separately to construct a surface discharge-type, AC-mode color PDP in which are seen three colors of red, blue and green.

The AC-mode color PDP thus fabricated herein displays high-contrast, sharp images.

EXAMPLE 2

On the surface of a glass substrate of a front plate, aligned are plural display electrode pairs at a predetermined pitch (1080 μm) so that they run at right angles to the address electrodes as formed on a back plate. Each display electrode pair is in the form of a composite electrode composed of a transparent electrode (sustain electrode) and a low-resistance metal electrode (bus electrode). The transparent electrodes may be of tin oxide ($SnO_2$) or indium tin oxide (ITO). In this Example, used is ITO for the transparent electrodes. To form them, employable is any of a sputtering method, a vapor deposition method, a printing method for which is used a paste, etc. In this Example, the transparent electrodes are formed according to a sputtering method. The thickness of each transparent electrode is 0.2 μm or so. Precisely, after the ITO film for the transparent electrodes are formed, this is coated with a resist, which is then dried, exposed and developed into a desired resist pattern on the ITO film. After this, the ITO film is etched via the resist pattern to form the intended transparent electrodes of ITO each having a width of 240 μm. One transparent electrode has a resistance value of not lower than tens KΩ (in a diagonal 42-inch full color PDP). The electric resistance of the metal electrodes to be combined with those transparent electrodes must be lower than that of the transparent electrodes. In that condition, the metal electrodes may be of Cr/Cu/Cr, aluminium or silver. In this Example, Cr/Cu/Cr is used for the metal electrodes. To form a film for them, used is a sputtering method. The thickness of the film thus formed for metal electrodes is 1 μm or so. Like the transparent electrodes, the metal electrodes of Cr/Cu/Cr are formed through photolithography, and each has a width of 60 μm. In each composite electrode pair, each metal electrode is formed on one remoter side of each transparent electrode in such a manner that the two metal electrodes are positioned on the opposite sides relative to the center of the two transparent electrodes.

Next, shield layers are formed. Precisely, a black pigment-containing photoresist layer is formed on the entire surface of the substrate, according to a screen-printing method, and then dried. This is then exposed via a photomask having a mask pattern for the non-image regions (non-discharge regions) between the adjacent display electrode pairs. This is developed, and dried in a drying furnace at 150° C. for 10 minutes to form the intended shield layers. The black pigment is of an oxide of iron, copper or manganese. The pigment is mixed with a photosensitive material to prepare the photoresist. For this, for example, a pigment-dispersed photoresist (trade name, CFPR BK, from Tokyo Ohka Industry) is usable.

After the shield layers have been formed, a dielectric layer is formed over them. Precisely, for forming the dielectric layer, a low-melting-glass paste is printed according to a screen-printing method, and then baked at 550° C. The thickness of the baked dielectric layer must be enough to completely cover all the display electrodes and the shield layers that underlie the dielectric layer, and is 10 μm in this Example. After the dielectric layer has been formed, a protective layer of MgO (magnesium oxide) is formed thereover to entirely cover the dielectric layer. The MgO film is formed through vapor deposition, and its thickness is 0.5 μm.

The front plate having the shield layers thus formed in the manner as above is combined with the back plate having been prepared in Example 1 to construct a surface discharge-type, AC-mode color PDP in which are seen three colors of red, blue and green.

The AC-mode color PDP thus fabricated herein has solved the first to fourth problems with the related art PDP noted above. If the phosphor layers are not on the back plate, the ambient light entering the panel is scattered on the exposed dielectric layer to degrade the contrast and the sharpness of the panel screen. Such additional problem is solved by the PDP structure of this Example. Therefore, the AC-mode color PDP fabricated herein displays high-contrast, sharp images.

EXAMPLE 3

On the inner surface of a glass substrate of a back plate, aligned are address electrodes at a predetermined pitch (360 μm) so that they run at right angles to the display electrode pairs as formed on a front plate. The address electrodes are of silver, as formed according to a printing method for forming thick films. Precisely, a mixture of silver powder and glass powder is mixed with an organic solvent and a resin to prepare a paste. This is patterned on the substrate of the back plate according to a printing method. Then, this is leveled at room temperature for 10 minutes to thereby smooth the surface of the pattern, and thereafter dried at 100° C. for 15 minutes. The thus-dried film is then baked in a baking furnace at 580° C. for 60 minutes to remove the organic substances from it. After the address electrodes have been formed in that manner, a dielectric layer is formed thereover. Precisely, for the dielectric layer, prepared is a paste comprising 100 parts by weight of glass powder (of low-melting-point lead glass), 30 parts by weight of a black pigment (of a powdery mixture of Mn, Fe, Cu oxides) and 5 parts by weight of $BaO_2$ powder which is a discoloration inhibitor for the black pigment, to which are added an organic solvent and a resin. The paste is printed over the address electrodes according to a screen-printing method, and then baked at 560° C. The thickness of the baked dielectric layer must be enough to completely cover all the address electrodes. In this Example, the thickness of the address electrodes is 6 μm, and that of the dielectric layer is 10 μm. Next, the thus-coated substrate is processed in the same manner as in Example 1 to prepare the back plate for PDP. The back plate having phosphor layers formed thereon is combined with a front plate having been prepared separately to construct a surface discharge-type, AC-mode color PDP in which are seen three colors of red, blue and green.

As having the dark layer formed in the manner mentioned herein, the AC-mode color PDP thus fabricated has solved the first to fourth problems with the related art PDP noted above. If the phosphor layers are not on the back plate, the ambient light entering the panel is scattered on the exposed dielectric layer to degrade the contrast and the sharpness of the panel screen. Such additional problem is solved by the PDP structure of this Example. Therefore, the AC-mode color PDP fabricated herein displays high-contrast, sharp images.

As has been mentioned in detail hereinabove with reference to its preferred embodiments, the invention provides a plasma display panel having the advantage of displaying high-contrast and sharp image informations and others, and the back plate for the PDP, and also provides methods for fabricating them.

Though depending on its different aspects in some degree, the invention has the basic advantages of the following five matters.

1. Even when the ultraviolet rays as generated through the discharge in the display regions in the plasma display panel leak out into the non-display regions therein, the phosphor layers in the non-display regions do not emit light. Therefore, one of the first advantage of the PDP of the invention is that the non-display regions are not brightened. Another is that the image regions are not brightened to a higher degree over their original brightness.

2. The UV rays as generated through the discharge in the display regions excite the phosphor layers in the display regions to make the layers emit light. Even though the thus-emitted light leaks into the non-display regions, the non-display regions are not brightened. This is the second advantage of the invention.

3. When the ambient light enters the plasma display panel, the color of the phosphor layers in the non-display regions is not seen through the front plate of the panel. This is the third advantage of the invention.

Concretely, even when the plasma display panel is used in light, the ambient light entering the panel is not scattered on the non-display regions not having phosphor layers therein, and therefore, the non-display regions are prevented from being seen whitish in light.

4. The plasma display panel of the invention has solved the problem that the ambient light entering the panel passes through the phosphor layers therein, and then scattered on the dielectric layers to again enter the phosphor layers as provided in the non-display regions to give scattered light. This is the fourth advantage of the invention. Because of this advantage, the non-display regions in the PDP of the invention are not seen whitish.

5. In addition, the ambient light having entered the PDP is prevented from being scattered in the area of the dielectric layer not having phosphor layers thereon. This is the fifth advantage of the invention.

Specifically, in the first aspect of the invention, phosphor layers are formed between the adjacent ribs, intermittently in the lengthwise direction of the ribs for each pixel. Therefore, the first aspect has the advantages 1 and 3.

In the first aspect, linear shield layers may be provided between the adjacent display electrode pairs on the front plate. With that constitution, the first aspect has the advantages 1, 2, 3 and 4.

In the second aspect of the invention, a light-absorbing layer is provided to cover the address electrodes, and phosphor layers are formed between the adjacent ribs, intermittently in the length wise direction of the ribs for each pixel. Therefore, the second aspect has the advantages 1, 3, 4 and 5.

In the second aspect, in addition, the light-absorbing layer as provided to cover the address electrodes on the back plate contains a dark pigment and a dielectric substance. Therefore, the second aspect has the advantages 1, 3, 4 and 5.

In the third aspect of the invention, plural pairs of surface discharge-type display electrodes each are in the form of a composite electrode composed of a sustain electrode which is a transparent electrode and a bus electrode which is a non-transparent metal electrode. Therefore, the luminescence efficiency of the PDP of the third aspect is much increased. In addition, a dark dielectric layer is provided to cover the address electrodes in the third aspect. With that constitution, the third aspect has the advantages 4 and 5. Moreover, the phosphor layers of three different colors are all provided intermittently in the lengthwise direction of the ribs. With that constitution, therefore, the third aspect has the advantages 1, 3, 4 and 5.

Further, linear shield layers are provided between the adjacent display electrode pairs on the front plate in the third aspect. With that constitution, the third aspect has the advantages 1, 2, 3, 4 and 5.

In the fourth aspect of the invention, a dark dielectric layer is provided to cover the address electrodes, and phosphor layers of three different colors are provided intermittently in the lengthwise direction of the ribs. Therefore, the fourth aspect has the advantages 1, 3, 4 and 5.

In the fourth aspect, it is desirable that the dark dielectric layer contains a dark pigment and a dielectric substance. With that preferred constitution, the fourth aspect has the advantages 1, 3, 4 and 5.

In the firth aspect of the invention, phosphor layers are not present in the regions on the back plate that correspond to the regions between the adjacent display electrode pairs that undergo surface discharge. Therefore, the firth aspect has the advantages 1 and 3.

In addition, in the fifth aspect, linear shield layers are provided between the adjacent display electrode pairs on the front plate. With that constitution, therefore, the fifth aspect has the advantages 1, 2, 3 and 4.

Moreover, in the fifth aspect, provided is a dark layer in the entire interface below the phosphor layers on the back plate. With that constitution, the fifth aspect has the advantages 1, 2, 3, 4 and 5.

According to the sixth aspect of the invention for forming a phosphor screen, used is a mask pattern for masking the regions between subpixels in forming the phosphor layers through photolithography. In this method, therefore, the phosphor layer pattern can be formed with accuracy and in a simplified manner. The plasma display panel thus fabricated according to this method has the advantages 1 and 3.

In all the first to sixth aspects of the invention, the amount of the phosphor to be used is reduced, and, therefore, the production costs for the PDP of the invention could be reduced.

While the invention has been described in detail and with reference to specific embodiments thereof, it will be apparent to one skilled in the art that various changes and modifications can be made therein without departing from the spirit and scope thereof.

What is claimed is:

1. A plasma display panel comprising:

a front plate and a back plate parallel to and facing each other having a space therebetween for a discharge gas, plural pairs of display electrodes for surface discharge on the front plate parallel to each other, with each display electrode pair comprising a sustain electrode and a bus electrode, a dielectric layer covering the display electrodes, and a protective film overlying the dielectric layer, address electrodes on the back plate at right angles to the display electrode pairs, and a dielectric layer covering the address electrodes, and linear ribs located between the address electrodes, with phosphor layers located on the ck plate between the adjacent linear ribs so that they each extend intermittently in the lengthwise direction of the ribs for each pixel wherein (1) each phosphor layer covers both the surface of the dielectric layer and the surface of the linear ribs within each pixel, (2) each pixel is formed by a crossing region of the address electrode and the display electrode pair, and (3) each phosphor extends intermittently in the lengthwise direction of the ribs creating regions on the ribs and the dielectric layer that have no phosphor layer and that correspond to the regions between the adjacent display electrode pairs.

2. The plasma display panel as claimed in claim 1, further comprising linear shield layers on the front plate parallel to each other, wherein each shield layer is located between an adjacent display electrode pair to be parallel to the display electrode pairs.

3. A plasma display panel comprising:

a front plate and a back plate parallel to and facing each other having a space therebetween for a discharge gas, plural pairs of display electrodes for surface discharge on the front plate parallel to each other, with each display electrode comprising a sustain electrode and a bus electrode, a dielectric layer covering the display electrodes, and a protective film overlying the dielectric layer, address electrodes on the back plate at right angles to the display electrode pairs, and a light-absorbing layer covering the address electrodes, and linear ribs located between the address electrodes, with phosphor layers located on the back plate between the adjacent linear ribs so that they each extend intermittently in the lengthwise direction of the ribs for each pixel, wherein (1) each phosphor layer covers both the surface of the dielectric layer and the surface of the linear ribs within each pixel, (2) each pixel is formed by a crossing region of the address electrode and the display electrode pair, and (3) each phosphor extends intermittently in the lengthwise direction of the ribs creating regions on the ribs and the dielectric layer that have no phosphor layer and that correspond to the regions between the adjacent display electrode pairs.

4. The plasma display panel as claimed in claim 3, wherein the light-absorbing layer contains a dark pigment and a dielectric substance.

5. A plasma display panel comprising:

a front plate and a back plate parallel to and facing each other having a space therebetween for a discharge gas, plural pairs of display electrodes for surface discharge on the front plate parallel to each other, with each display electrode comprising a transparent sustain electrode and a non-transparent metal bus electrode, a translucent dielectric layer covering the display electrodes, and a magnesium oxide-containing, translucent protective film overlying the dielectric layer, address electrodes on the back plate at right angles to the display electrode pairs, and a dark dielectric layer covering the address electrodes, linear ribs located between the address electrodes, and phosphor layers provided on the back plate between the adjacent linear ribs so that a red-emitting phosphor layer, a blue-emitting phosphor layer and a green-emitting phosphor layer adjacent each other with a rib therebetween and these three different phosphor layers each extend intermittently in the lengthwise direction of the ribs, wherein (1) each phosphor layer covers both the surface of the dielectric layer and the surface of the linear ribs within each pixel, (2) each pixel is formed by a crossing region of the address electrode and the display electrode pair, and (3) each phosphor extends intermittently in the lengthwise direction of the ribs creating regions on the ribs and the dielectric layer that have no phosphor layer and that correspond to the regions between the adjacent display electrode pairs.

6. The plasma display panel as claimed in claim 5, further comprising linear shield layers on the front plate parallel to each other, wherein each shield layer is between the adjacent display electrode pairs and parallel to the display electrode pairs.

7. A plasma display panel comprising:

a front plate and a back plate parallel to and facing each other having a space therebetween for a discharge gas, plural pairs of display electrodes for surface discharge on the front plate parallel to each other, with each display electrode pair comprising a sustain electrode and a bus electrode, a dielectric layer covering the display electrodes, and a protective film overlying the dielectric layer, address electrodes on the back plate at right angles to the display electrode pairs, and a dielectric layer covering the address electrodes, and linear ribs located between the address electrodes, with a phosphor layer located on the back plate in each of a plurality of adjacent cell spaces formed by a plurality of adjacent linear ribs, said phosphor layers being intermittently interrupted creating regions on the ribs that have no phosphor layer and that corresponds to the regions between the adjacent display electrode pairs wherein (1) each phosphor layer covers the surface of the dielectric layer and the surface of the linear ribs within each pixel, and (2) each pixel is formed by a crossing region of the address electrode and the display electrode pair.

8. The plasma display panel as claimed in claim 7, further comprising shield layers in the regions between the adjacent and parallel to the display electrode pairs on the front plate.

9. The plasma display panel as claimed in claim 7, further comprising a dark layer on the entire surface of the back plate below the linear ribs and below the phosphor layers.

* * * * *